United States Patent [19]

Ford et al.

[11] 4,051,008

[45] Sept. 27, 1977

[54] FLANGED CONNECTION MEANS FOR ANODE POSTS IN ELECTROLYTIC DIAPHRAGM CELLS

[75] Inventors: James M. Ford, Cleveland, Tenn.; Morton S. Kircher, Oakville, Canada; Hugh A. Mosher, Paget East, Bermuda

[73] Assignee: Olin Corporation, New Haven, Conn.

[21] Appl. No.: 672,370

[22] Filed: Mar. 31, 1976

[51] Int. Cl.[2] ..... C25B 1/16; C25B 1/26; C25B 9/02

[52] U.S. Cl. ..... 204/266; 204/263; 204/286; 204/288

[58] Field of Search ..... 204/95, 98, 128, 129, 204/252, 258, 266, 282, 283, 286, 288, 263

[56] References Cited

U.S. PATENT DOCUMENTS

| | | | |
|---|---|---|---|
| 3,591,483 | 7/1971 | Loftfield et al. | 204/286 X |
| 3,612,751 | 10/1971 | Adaev et al. | 204/286 X |
| 3,743,592 | 7/1973 | Metcalff | 204/286 X |
| 3,883,415 | 5/1975 | Shibata et al. | 204/258 |
| 3,891,531 | 6/1975 | Bouy et al. | 204/266 X |

*Primary Examiner*—Arthur C. Prescott

*Attorney, Agent, or Firm*—Bruce E. Burdick; Donald F. Clements; Thomas P. O'Day

[57] ABSTRACT

An improved means for connecting anode posts to diaphragm cell bases is described which utilizes anode posts which are soldered at the lower end of each post in an opening in the cell base to provide a good electrical connection. A flange is positioned on the anode post above the soldered connection. The space between the bottom of the flange and the interior surface of the cell base is filled with a suitable washer to provide a liquid-tight seal.

9 Claims, 3 Drawing Figures

FLANGED CONNECTION MEANS FOR ANODE POSTS IN ELECTROLYTIC DIAPHRAGM CELLS

This invention relates to an electrolytic diaphragm cell having improved connection means for anode posts.

Electrolytic cells have been used extensively in the preparation of chlorine and caustic by the electrolysis of brine in a number of different cell designs. One of the problems in all of these designs is how to provide a satisfactory means for conducting current from the ambient side or exterior surface of the electrolytic cell, through the cell base or wall to the anode of the cell.

One type of cell, the electrolytic diaphragm cell is typically constructed of a steel cell can or body, a concrete top, and a concrete base. Graphite anodes are secured with lead and an asphaltic sealer in the cell base, and steel mesh cathodes coated with an asbestos diaphragm are suspended from the side of the cell body. Recently the graphite anodes have been replaced by metallic electrodes having a suitable conducting coating on the outer surface of the anodes. It is preferable not to use lead as the major support for these metallic anodes as in prior art techniques because of its poor electrical conductivity, its softness, and its potential for environmental contamination. As a result of this and the desire to improve electrical connections to these new metallic anodes, the structure of the conventional electrolytic diaphragm cell had to be modified in order to permit an improved installation of the dimensionally stable anodes.

U.S. Pat. No. 2,799,643, issued to C. W. Raetzsch on July 16, 1957, discloses a cell design for passing current to anodes secured to the sides of the cell container. This patent discloses cell bodies constructed of various non-conductive materials such as rubber covered steel.

U.S. Pat. No. 3,591,483, issued July 6, 1971, to Loftfield et al, describes a cell modification in which the cell base is a laminate of an electrically non-conductive sheet covering a metallic conducting and supporting cell base. Holes for receiving anode posts are formed in the non-conductive sheet and cell base and threaded anode posts are extended through the holes and secured to the cell base with threaded nuts and a suitable washer. The holes in the sheet are larger than the anode post.

U.S. Pat. No. 3,891,531, which issued on June 24, 1975, to Bouy et al., describes a technique for securing anode posts to conductive cell bases employing either a flanged anode post with a threaded bottom which extends through the cell base, or an anode post having an outside diameter equal to or larger than the diameter of the opening in the cell bottom at operating conditions, with internal channels in the lower portion of the anode post for conducting nitrogen gas for freezing the lower portion of the post to reduce its diameter prior to inserting it into the opening in the cell base. Subsequent expansion of the lower portion of the anode post provides a friction type liquid tight seal.

Although designs such as these represent an improvement over conventional concrete electrolytic cells, one of the problems encountered in the use of presently available anode post designs in the limited period of good electrical conductivity obtainable with threaded connections in a corrosive atmosphere. Likewise, the utilization of anode posts having internal channels for liquid nitrogen is a relatively expensive and cumbersome means of obtaining a liquid tight seal in electrolytic diaphragm cells.

There is a need at the present time for an improved means for connecting anode posts to electrolytic diaphragm cells.

It is a primary object of this invention to provide an improved electrode connection for electrolytic diaphragm cells.

Another object of the invention is to provide an improved electrolytic diaphragm cell in which anodes can be easily replaced or positioned within the cell.

Still another object of the invention is to provide a novel means for connecting anode posts in electrolytic diaphragm cells.

These and other objects of the invention will be apparent from the following detailed description thereof.

It has now been discovered that the foregoing objects of the invention are accomplished in an electrolytic diaphragm cell comprised of a cell base having a cell body secured thereto, said cell base having a conducting layer forming an exterior surface and an interior layer forming an interior surface, an interface between the conducting layer and the interior layer, a plurality of diaphragm-coated cathodes secured to said cell body, a plurality of anodes, each of said anodes being comprised of a metallic conductive surface secured to an anode post, each of said anode posts being secured to said cell base, each anode being positioned adjacent and parallel to at least one cathode, said cell base having an opening for each of said anode posts, and current conducting means secured to said exterior surface of said cell base, characterized by the improvement which comprises:

a. anode posts having the lower end of each secured in one of said openings by solder positioned between said conducting layer and said anode post,
b. a flange positioned on each of said anode posts above the soldered connection, and
c. sealing means between the flange and the interior surface to provide a liquid-tight seal.

The same number is used to identify a component when it appears in more than one figure.

Figure 1:
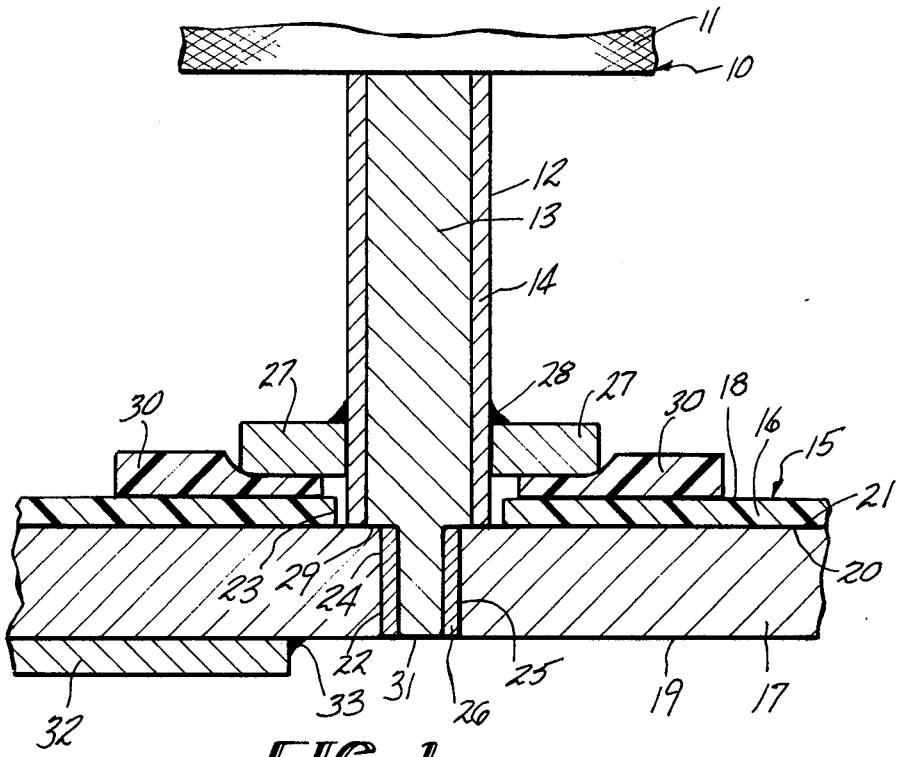
FIG. 1 is a sectional view of one embodiment of the invention in which the anode posts have a metal flange secured by welding to the lower portion of each anode post, and the anode posts are secured by solder to the cell base in openings which extend completely through the conducting layer of the cell base.

More in detail, FIG. 1 shows anode 10 comprised of metal surface 11 and anode post 12. Metal surface 11 may be a solid sheet, mesh or other suitable anode form comprised of a titanium base coated with at least one metal and/or metal oxide of a platinum group metal such as platinum or ruthenium oxide. However, other suitable metals, metal oxides, and mixtures thereof useful as these metal surfaces are well known in the art.

Anode post 12 is comprised of core 13 clad with exterior sheet 14. Usually anode core 13 is constructed of aluminum, copper, iron, steel, and the like and is clad with an exterior sheet 14 of corrosion resistant metal such as titanium. Although titanium is generally utilized for exterior sheet 14, other suitable metals of construction which resist corrosion by the electrolyte include tantalum, columbium, and zirconium.

Cell base 15 is a laminated cell base comprised of an upper interior layer 16 secured to a lower conducting layer 17.

Interior layer 16 has an interior surface 18 which serves as the floor of the cell to contain the electrolyte. Interior layer 16 is generally a nonmetallic corrosion resistant material such as rubber, polyethylene, chlorinated polyvinyl chloride, polypropylene, acrylonitrile-butadiene-styrene polymers (ABS), polytetrafluoroethylene (PTFE), polyvinylidene fluoride polyester (PVFP), fluorinated ethylene propylene (FEP), ethylene chlorotrifluoroethylene (E-CTFE), mixtures thereof and the like. The use of fiber reinforcement, such as fiber glass, in the material used to form interior layer 16 is satisfactory, but hard rubber is the preferred composition of interior layer 16. A sheet of fluorinated ethylene propylene (FEP) sold commercially under the trademark "TEFLON FEP" by the duPont Company or a coating of polyvinylidene fluoride polyester sold commercially under the trademark "KYNAR" by the Pennwalt Corporation may also be used as interior layer 16.

Lower conducting layer 17 has an exterior surface 19, and is constructed of aluminum, copper, iron, alloys of at least one of these metals, and the like. Copper is preferably used as conducting layer 17, which may be joined at conducting layer top 20 with a suitable cement (not shown) to form interface 21 with interior layer 16 which provides a corrosion resistant bond over substantially the entire area of contact between interior layer 16 and conducting layer 17. Exterior surface 19 is generally exposed to the atmosphere.

A separate opening 22 is formed in cell base 15 for receiving each anode post 12. In the embodiment of FIG. 1, opening 22 is comprised of interior layer opening 23 in interior layer 16 and conductive layer opening 24 in conducting layer 17. Conducting layer opening 24 extends from conducting layer top 20 downwardly along walls 25 through conducting layer 17 to exterior surface 19. Walls 25 of conductive layer opening 24 provide adhering surfaces for solder 26 to secure anode posts 12.

The portion of anode post 12 which extends into opening 22 has exterior sheet 14 removed, exposing core 13 to solder 26 for better adhesion of solder 26. Generally any soft solder is suitable solder for securing anode post 12 to conducting layer 17. A typical suitable solder is comprised of from about 25 to about 60 percent tin by weight, the balance being lead and traces of other metals. Another suitable solder contains 95 percent tin and 5 percent silver.

A metal washer 27 formed of titanium, tantalum, columbium, zirconium, or the like is secured by anode post welding 28 to anode post 12, to form a flange to provide. In addition a flanged face 29 is formed on the lower portion of the anode post 12 to provide a seat for anode post 12 to rest on conducting layer top 20. The location of metal washer 27 is closed enough to interior layer 16 to form a liquid-tight seal with gasket 30 by applying pressure to the top of anode post 12 and soldering the post in opening 22 while gasket 30 is under pressure so as to isolate solder 26 from the electrolyte contained by interior layer 16.

Installation of the anode posts in the cell base is generally effected one anode post at a time. During the installation, cell base 15 preferably is inverted with exterior surface 19 facing upwardly, and the cell base is positioned high enough above the floor to permit installation of anodes 10 from below. Anode 10 with metal surface 11, anode post 12 and metal washer 27 is placed on the interior of the cell with tip 31 directed upwardly and positioned in one cell base opening 22, with flanged face 29 pressed securely against conducting layer top 20 in a suitable jig (not shown). Anode post 12 is positioned concentric with opening 23.

The space between wall 25 and anode post 12 is filled with a suitable solder. A high intensity heat source, such as an electric current or plasma jet flame is then applied to tip 31 for a short period of time in order to fill the space with molten solder to thereby provide an indirect contact between anode post 12 and wall 25, (which on cooling forms a sound joint) without damage to interior layer 16. For example, the surfaces to be soldered are heated to a temperature of about 450° F. for a maximum of about 60 seconds, but generally for about 5 seconds.

After removal of the heat source, the solder is allowed to cool and solidify while maintaining flanged face 29 securely against conducting layer top 20. The resulting sound electrical joint between the anode post and the cell base is a very efficient connection, and a liquid tight seal is formed between metal washer 27 and interior layer 16. After all of the anode posts 12 have been secured to cell base 15 by soldering, the cell base is reverted to its upright position and installed in series with the operating cells.

Conductor 32 is secured to the conducting layer 17 of cell base 15 by conductor welding 32, bolts (not shown) or otherwise in order to provide a strong electric contact with the bottom of conducting layer 17. Conductor 32 is preferably constructed of copper, but other materials such as aluminum may be used, if desired.

Figure 2:
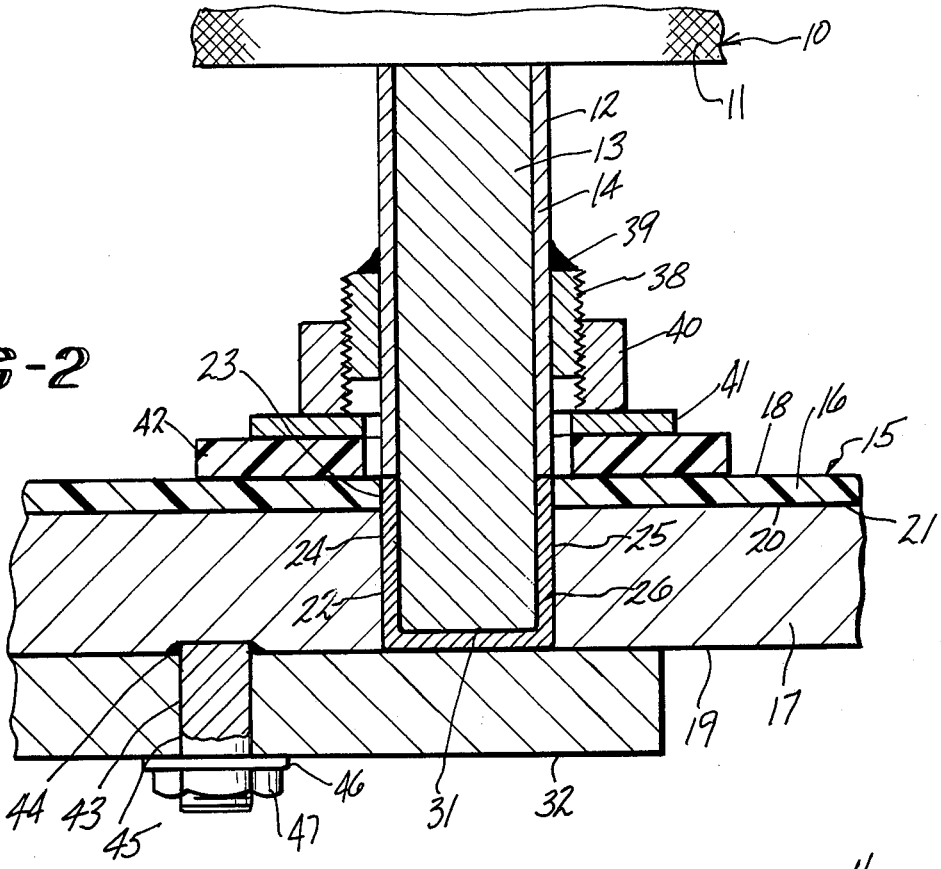
FIG. 2 shows an embodiment of the invention in which the flange is provided with an exterior thread, and a liquid tight seal is obtained by tightening a nut on the thread against a flexible washer between the flange and the interior surface of the cell base.

FIG. 2 shows another embodiment of the invention in which a threaded flange 38 is secured by flange welding 39 to anode post 12, and nut 40 is tightened on threaded flange 38 against metal washer 41 and gasket 42 to obtain a liquid-tight seal.

In the embodiment of FIG. 2, conductor post 43 is secured to exterior surface 19 of conducting layer 17 by means of conductor post welding 44 or other suitable means. Conductor 32 having conductor opening 45 is placed in electrical contact with exterior surface 19 by passing conducting post 43 through conductor opening 45, securing a post washer 46 and a post lock nut 47 on the lower threaded portion of conductor post 43, and tightening against conductor 32 in order that the upper side of conductor 32 is in electric contact with exterior surface 19 of cell base 17. It is preferred to employ a thread sealant (not shown) between threaded flange 38 and nut 40 to inhibit leakage of electrolyte.

Figure 3:
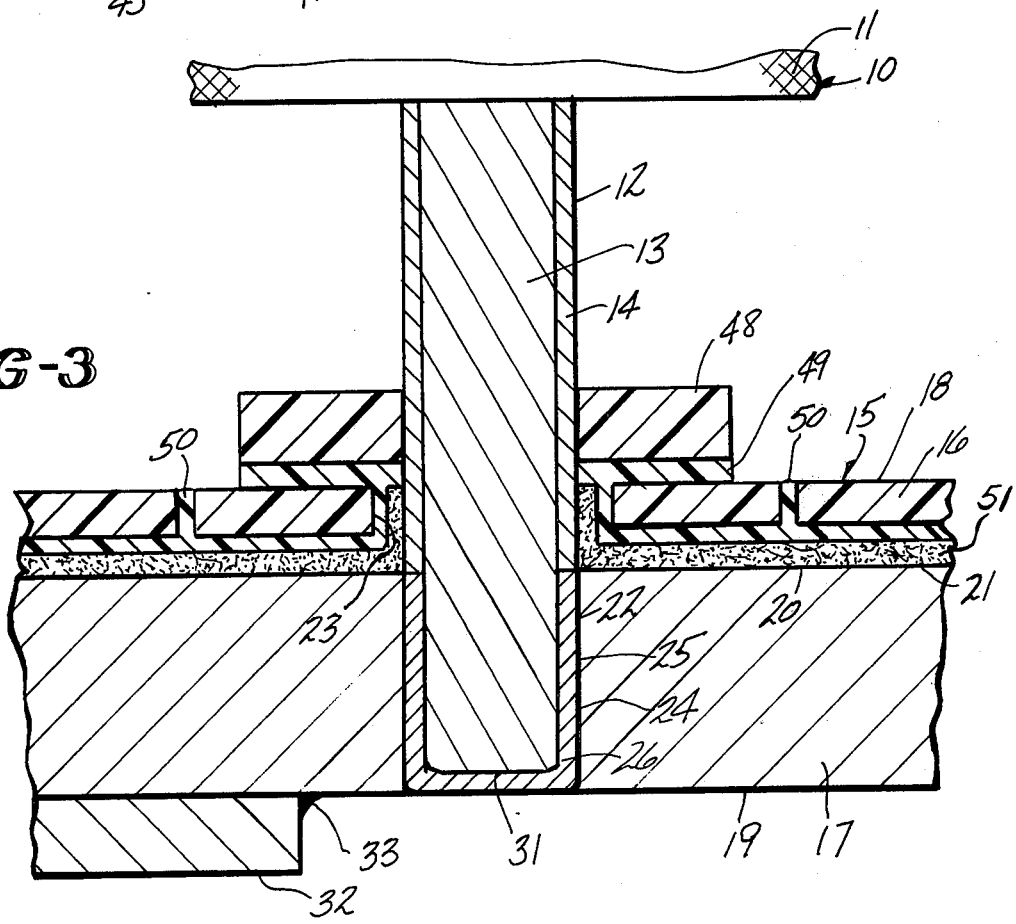
FIG. 3 shows an embodiment of the invention in which a plastic washer is press fitted on the anode post to form a flange and the anode post is secured in an opening which extends completely through the conducting layer.

FIG. 3 shows another embodiment of the invention in which anode post 12 is provided with a plastic flange 48. Any suitable plastic which is resistant to the electrolyte and which is rigid, or substantially nonflexible during the conditions obtained during cell operation may be employed in the construction of plastic flange 48. Typical suitable compositions include high temperature polyvinylchloride and the like. Plastic flange 48 is in the form of a washer having an opening in the center with a diameter which is substantially identical and preferably smaller than the outside diameter of anode post 12. Plastic flange 48 is pressfitted onto anode post 12 to form a substantially permanent connection between plastic flange 48 and anode post 12. Alternatively, plastic flange 48 may be sealed to anode post 12 with a suitable plastic adhesive (not shown).

In the embodiment of FIG. 3, each anode post 12 having plastic flange 48 secured thereto is inserted into conductor opening 24. A suitable mastic layer 51, such as asphalt is applied to conducting layer top 20 and around anode post 12. Solder 26 is applied to conductor layer opening 24 to obtain electrical contact and secure the anode post in conducting layer 17. A suitable cement such as furan cement 49 is applied under pressure through cement openings 50 in interior layer 16 until the cement contacts plastic flange 48, anode post 12 and mastic layer 51. Curing of the cement provides a liquid-tight seal between plastic flange 48, mastic layer 51 and interior layer 16.

Anode posts 12 of FIGS. 2 and 3 may be installed in a similar manner as described above with respect to the anode posts of FIG. 1, using a jig or individual anode installation.

It will be recognized by those skilled in the art that the embodiments presented in the FIGS. can be modified wherein the opening for each anode post in conducting layer 17 may not extend completely through the cell base, if desired.

If desired, a small key, (not shown) may be secured to the lower portion of each anode post for fitting into a corresponding key-way in each opening 24 in order to optimize the position of anode posts 12 in openings 24. Alternatively, the key may be positioned in opening 24 and the key-way in the side of the lower portion of anode posts 12.

If during the course of refurbishing the cell it is necessary to replace anode 10, solder 26 is melted, and anode 10 is withdrawn from the cell for renewal of metal surface 11. Another anode 10 may be installed in place of the one removed.

The number of anodes 10 in the cell will usually correspond to the number of diaphragm-coated cathodes in the cell. The electrodes are positioned in the cell alternately, generally in a vertical position, with one anode being next to and spaced apart from a cathode. The cathodes are generally secured to the side of the cell and the anodes are positioned with anode posts 12 in at least one substantially straight row across the cell base 15. The number of anodes in each row and the number of rows of anodes, which corresponds to the number of conductors 32 in each cell, is not critical. Generally, the number of anodes in a row may range from about 2 to about 50 and preferably from about 10 to about 35 anodes per row. The number of rows of anodes (or conductors 32) may range from 1 to about 10 and preferably from about 1 to about 6 rows of anodes per cell. In a cell of this type, chlorine is produced at the anode, hydrogen is produced at the cathode, and each gas is collected separately.

Conductor 32 is generally a copper bar having a rectangular-shaped cross section, which is generally an extension of the bus bar from an adjacent cell. If desired, in order to provide a substantial uniform current distribution in anode posts 12 extending throughout each straight row of anode posts, conductor 32 is tapered to provide decreasing thickness from the first anode post 12 in a given row to the opposite side of cell base 15. As a result, when conductor 32 is secured to a power source such as by securing it to an operative bus bar and current is fed to conductor 32 a relatively uniform current distribution is achieved in anode posts 12 in each straight row across cell base 15.

The relative thickness of interior layer 16 and conducting layer 17 may also be varied with the size and shape of the electrolytic diaphragm cell. In a typical cell design, interior layer 16 is about ¼ inch thick and conducting layer 17 is about 1 inch thick. However, the thickness of interior layer 16 may range from about ⅛ to about 1 inch, and the thickness of conducting layer 17 may range about ½ inch to about 2 inches or more. Thicknesses which provide the desired degree of support without undue expense are usually employed.

Various modifications may be made in the invention without being outside the scope of the invention. For example, anode posts 12 have been illustrated and described as being cylindrical in cross sectional area, but rectangular,square or other forms of cross sectional area may be used instead of cylindrical rods. In addition, flange 29 on anode posts 12 may be omitted, if desired.

The novel anode connection of this invention may also be used in other electrolytic cells, such as the chlorate type, where the diaphragm is omitted and the product is sodium chlorate, or in cells where the anode connections are through the side of the cell.

Advantages of using the novel conducting means and anode connection of this invention include the following:

1. Shortened anode posts 12 are less expensive than anode posts which extend through the cell base, with threaded extensions.
2. Good soldered electrical connections reduce power loss.
3. Improved seals reduce corrosion of cell base and anode posts by cell liquors.
4. Less expensive materials of construction and assembly means can be employed.

EXAMPLE

A diaphragm cell of the type disclosed in U.S. Pat. No. 2,447,547, issued to K. E. Stewart on Aug. 24, 1948, is modified to include the anode attachment means described in FIG. 1 and the conductor attachment means of FIG. 3.

A cell base having an overall dimension of 63 inches by 56¼ inches is constructed of a 1 inch copper plate as conducting layer 17 coated with a ¼ inch thick hard rubber interior liner, as interior layer 16. Two series of anode posts holes are drilled in the cell base. Each series of holes is positioned in a straight line equidistant and parallel to the center line of the base about 14 inches from the center line and 28 inches from each other. The center line of the cell base is perpendicular to the 63 inch side of the cell. Each series of holes contains 16 holes, the centers of which are approximately 3 inches apart, the last hole in each series being approximately 4¾ inches from the edge of the cell base. The diameter of each hole is 1.125 inches.

Thirty-two anodes are placed in these holes, each anode being comprised of a mesh portion secured to the central anode posts having a metal washer welded to the lower portion of the anode post. The mesh portion of each anode is approximately 24½ inches in width, 1¼ inches thick, and 18¼ inches in height, being secured at the center of its short dimension to an anode post having a diameter of approximately 1.125 inches. The length of these anode posts is approximately 27¾ inches and the upper edge of the mesh portion is located about ¾ inch from the top of the anode post.

Each anode post is constructed of a copper core clad with 0.04 inch thick tube of titanium on about the upper 22 15/16 inch portion of the anode post. The titanium and a slight amount of copper is machined off of the base of each rod to leave a cylindrical copper base section ⅞ inches long by 1.115 inches in diameter. The face of the anode post above this section acts as a flange which contacts conducting layer 17 and provides a seat for each anode post on the cell bottom.

A flange is secured to each anode post by welding perpendicular thereto a metal washer 3/16 inch thick and 2 inches in diameter. The bottom of each flange is 1¼ inches from the end of the anode post. A neoprene gasket, ¼ inch thick and 2 inches outside diameter, is placed under each flange.

Before assembly of the anodes into the cell base the holes in the cell base are cleaned with caustic and acid in preparation for soldering. Flux and solder paste (50 percent tin and 50 percent lead) are placed in each hole and the anodes are inserted one at a time through the holes in the cell base. Before melting the solder, a jig is set over the anodes to hold them in proper alignment and to apply sufficient pressure to compress the neoprene gaskets by about 25 percent. The cell base with jig is inverted and heat is applied to the top of each anode post by means of a plasma jet flame. The solder melts and flows within about 30 second at each connection. The temperature-time exposure of the upper surface 16 does not degrade the rubber liner or neoprene gasket. The anode assembly is returned to an upright position and after solidification of the solder, the jig is removed. The cell base is placed on an insulated frame in its operating position. The cathodes and cell can are then placed on the cell base. Suspended from the two sides of the cell can are 30 asbestos coated steel mesh cathodes alternately spaced between and parallel to the anodes.

The cell operates for extended periods with a minimum of maintenance and corrosion problems and with a high chlorine yield.

What is desired to be secured by Letters Patent is:

1. In an electrolytic cell including:

a. a cell base having:
   i. an interior layer which provides an interior surface, having a plurality of separate first openings therethrough, and
   ii. a conducting layer secured to said interior layer which provides an exterior surface, having a plurality of separate second openings therein,
   iii. said first and second openings being aligned to provide a plurality of separate openings in said cell base for a plurality of anode posts, b. a cell body secured to said cell base, c. a plurality of diaphragm-coated cathodes secured to said cell body, d. a plurality of anodes, each anode having
   1. an anode post secured to said cell base, and
   2. a metallic conductive surface secured to said anode post,
   3. each metallic conductive surface being positioned adjacent to and parallel to at least one of said cathodes, e. and current conducting means secured to said exterior surface, the improved securing means for securing said anode posts to said cell base, comprising;

f. separate soldered connections, between each of said anode posts and said cell base, in said separate openings for securing each anode post in indirect contact with the conducting layer in said cell base, and g. flange means, positioned on each of said anode posts above said soldered connection, for providing an upward seating surface and h. liquid-tight seal means, between said seating surface of said flange and said interior layer of each of said anode posts, for isolating said soldered connections from an interior space of said cell.

2. The electrolytic cell of claim 1 wherein the tip of said anode post is within said opening and above said exterior surface.

3. The electrolytic cell of claim 1 wherein said flange means is an external annular metal flange secured to the lower portion of said anode post.

4. The electrolytic cell of claim 3 wherein said metal flange is secured to said anode post by a force-fit technique.

5. The electrolytic cell of claim 1 wherein said flange means comprises:

i. an externally threaded annular male portion affixed to said anode post above said soldered connector; and ii. an internally threaded annular nut portion means, movably connected to the external threads of said male portion, for moving axially and rotationally relative thereto so as to compress said sealing means.

6. The electrolytic cell of claim 3 wherein said flange is plastic which is press-fitted on said anode post to provide a liquid-tight seal between the bottom of said plastic flange and said interior surface.

7. The electrolytic cell of claim 6 wherein said plastic flange is secured with adhesive to said interior surface.

8. The electrolytic cell of claim 3 wherein said anode post has a lower portion with a smaller diameter than the remainder of said anode post, the bottom of said remainder forming a second flange to seat each anode post in said opening against said conducting layer an inward facing surface of.

9. The electrolytic cell of claim 1 wherein said flange is plastic which is sealed to said anode post with plastic adhesive.

* * * * *

UNITED STATES PATENT OFFICE

CERTIFICATE OF CORRECTION

Patent No. 4,051,008 Dated September 27, 1977

Inventor(s) James M. Ford, Morton S. Kircher and Hugh A. Mosher

It is certified that error appears in the above-identified patent and that said Letters Patent are hereby corrected as shown below:

Column 1, line 64, "in" should be --is--.

Column 3, line 62, immediately after "provide" insert --an upward seating surface--.

Column 3, line 65, "closed" should be --close--.

Column 8, lines 52-53, delete "said conducting layer an inward facing surface of." and insert therefor --an inward facing surface of said conducting layer.--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*